US009360836B2

(12) United States Patent
Asano

(10) Patent No.: US 9,360,836 B2
(45) Date of Patent: Jun. 7, 2016

(54) IMAGE FORMING APPARATUS, METHOD OF CONTROLLING IMAGE FORMING APPARATUS, AND PROGRAM

(71) Applicant: CANON KABUSHIKI KAISHA, Tokyo (JP)

(72) Inventor: Kohei Asano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/581,896

(22) Filed: Dec. 23, 2014

(65) Prior Publication Data

US 2015/0212483 A1 Jul. 30, 2015

(30) Foreign Application Priority Data

Dec. 27, 2013 (JP) ..... 2013-272197

(51) Int. Cl.
*G03G 21/20* (2006.01)
*G03G 15/00* (2006.01)

(52) U.S. Cl.
CPC ..... *G03G 21/20* (2013.01); *G03G 15/5004* (2013.01); *G03G 15/80* (2013.01)

(58) Field of Classification Search
CPC ..... G03G 21/20; G03G 21/206; G03G 2221/1645
See application file for complete search history.

(56) References Cited

U.S. PATENT DOCUMENTS 5,073,796 A * 12/1991 Suzuki ..... G03G 15/04 355/30
5,138,375 A * 8/1992 Iimori ..... G03G 21/206 165/300
5,164,778 A * 11/1992 Tanabe ..... G03G 21/206 399/9
5,541,458 A * 7/1996 Hirst ..... H02J 9/00 257/119
5,561,496 A * 10/1996 Sugiura ..... G03G 15/00 29/469
5,787,323 A * 7/1998 Nomura ..... G03G 21/1853 399/111
5,828,462 A * 10/1998 Hashimoto ..... G03G 21/206 358/296
5,860,042 A * 1/1999 Tomaru ..... H04N 1/00519 399/92
5,887,226 A * 3/1999 Taki ..... G03G 21/206 399/92

(Continued)

FOREIGN PATENT DOCUMENTS

JP 2003076251 A * 3/2003
JP 2004-222234 A 8/2004

(Continued)

OTHER PUBLICATIONS

Machine translation of JP 2011067973 A.*

*Primary Examiner* — David Bolduc
(74) *Attorney, Agent, or Firm* — Canon USA, Inc., IP Division

(57) ABSTRACT

An image forming apparatus is provided in which, in receiving a job and processing an image, a central processing unit (CPU) that can be cooled by a cooling unit to which electric power is supplied from a power supply unit controls a printing unit. The CPU, after a power state of the image forming apparatus is shifted to a second power state lower in power consumption than a first power state, recognizes that a receiving unit has received a job for returning from the second power state to the first power state. Then, the CPU performs adjustment such that start timing for supplying electric power from the power supply unit to the cooling unit is delayed.

8 Claims, 7 Drawing Sheets

(56) References Cited

U.S. PATENT DOCUMENTS 6,324,361 B1 * 11/2001 Itoh ..... G03G 21/206 399/92
6,985,677 B2 * 1/2006 Yamagata ..... H04N 1/00981 399/18
7,228,204 B2 * 6/2007 Iino ..... H05K 7/20836 361/695
7,516,335 B2 * 4/2009 Watanabe ..... G06F 1/3209 713/300
8,218,992 B2 * 7/2012 Park ..... G03G 15/2039 399/44
8,768,194 B2 * 7/2014 Nakamura ..... G03G 15/2042 399/45
2002/0085856 A1 * 7/2002 Kuwabara ..... G03G 15/2003 399/92
2003/0219274 A1 * 11/2003 Hirose ..... G03G 21/206 399/92
2004/0120727 A1 * 6/2004 Komatsubara ..... G03G 21/206 399/92
2006/0117205 A1 * 6/2006 Sawada ..... G06F 1/206 713/500
2006/0204271 A1 * 9/2006 Tai ..... G03G 21/206 399/92
2006/0288331 A1 * 12/2006 Asakawa ..... G03G 15/5016 717/120
2006/0291894 A1 * 12/2006 Chung ..... G03G 21/206 399/92
2007/0047999 A1 * 3/2007 Itoh ..... G03G 21/206 399/92
2007/0098432 A1 * 5/2007 Mashiki ..... G03G 15/80 399/88
2008/0181643 A1 * 7/2008 Sato ..... G03G 15/2039 399/69
2008/0240741 A1 * 10/2008 Sasama ..... G06F 11/0733 399/9
2008/0240767 A1 * 10/2008 Asahina ..... G03G 21/206 399/92
2008/0308995 A1 * 12/2008 Tobinaga ..... G03G 15/602 271/8.1
2009/0059262 A1 * 3/2009 Takuwa ..... H04N 1/00496 358/1.13
2009/0207881 A1 * 8/2009 Nakatani ..... B41J 29/377 374/162
2009/0238597 A1 * 9/2009 Cao ..... G03G 15/2039 399/70
2009/0297176 A1 * 12/2009 Haruyama ..... G03G 15/168 399/27
2010/0158557 A1 * 6/2010 Kuroda ..... G03G 21/206 399/92
2010/0316408 A1 * 12/2010 Murata ..... G03G 15/5008 399/92
2011/0019217 A1 * 1/2011 Fujii ..... G03G 15/5004 358/1.13
2011/0020025 A1 * 1/2011 Fujii ..... G03G 21/206 399/75
2011/0026964 A1 * 2/2011 Yasumoto ..... G03G 21/206 399/94
2011/0064449 A1 * 3/2011 Shimizu ..... G03G 21/206 399/92
2011/0194870 A1 * 8/2011 Hase ..... G03G 15/2064 399/69
2011/0310412 A1 * 12/2011 Eguchi ..... G03G 21/00 358/1.9
2011/0311262 A1 * 12/2011 Miyazaki ..... G03G 21/206 399/92
2012/0026689 A1 * 2/2012 Ohno ..... G03G 21/206 361/695
2012/0128386 A1 * 5/2012 Katayama ..... G03G 15/50 399/91
2012/0134692 A1 * 5/2012 Soda ..... G03G 21/20 399/44
2012/0141155 A1 * 6/2012 Suzumi ..... G03G 15/5004 399/70
2012/0236353 A1 * 9/2012 Nagayama ..... G03G 15/5004 358/1.13
2013/0022366 A1 * 1/2013 Ando ..... G03G 15/205 399/70
2013/0084091 A1 * 4/2013 Taki ..... G03G 15/2046 399/67
2013/0136485 A1 * 5/2013 Takahashi ..... G03G 21/206 399/92
2013/0170852 A1 * 7/2013 Noguchi ..... G03G 15/2078 399/92
2015/0003859 A1 * 1/2015 Tanida ..... G03G 21/206 399/92
2015/0093140 A1 * 4/2015 Saeki ..... G03G 15/2017 399/92

FOREIGN PATENT DOCUMENTS

JP 2006056062 A * 3/2006
JP 2006085024 A * 3/2006
JP 2011067973 A * 4/2011

* cited by examiner

FIG. 4

| | | UNIT | | |
|---|---|---|---|---|
| | | CPU THERMOMETER | FAN* | PRINTING MECHANISM UNIT |
| JOB TYPE | PRINT | 1 | 10 | 100 |
| | STORE | 1 | 10 | 0 |

*: IF PROTECTION CIRCUIT IS PROVIDED, NOT IMMEDIATELY NECESSARY

IMAGE FORMING APPARATUS, METHOD OF CONTROLLING IMAGE FORMING APPARATUS, AND PROGRAM

BACKGROUND OF THE INVENTION

1. Field of the Invention

The present invention relates to an image forming apparatus, a method for controlling the image forming apparatus, and a program.

2. Description of the Related Art

Image forming apparatuses are provided with a standby mode in which driving devices such as a printing mechanism unit are stopped and a cooling fan is placed in a non-operating state to consume a lower power. In the standby mode, the image forming apparatus can stand by in a silent state. In the standby state, when job is input via a network, the image forming apparatus immediately returns to a normal operation mode, and processes the job. Japanese Patent Application Laid-Open No. 2004-222234 discusses a method of returning to a normal operation mode only a necessary mechanism such as a printer unit in an image forming apparatus at the time when the image forming apparatus returns to the normal operation mode.

As a psychophysical law relating to human perception, the Weber-Fechner law is known. The law states that the intensity of human perception to a stimulus increases in proportion to the logarithm of the magnitude of the stimulus. That is, for example, in a case of a sound level, although an absolute value of a sound level increase is the same, a change from a silent state to a low-sound level is more noticeable than a change from a middle-sound level to a high-sound level.

When the image forming apparatus returns from the standby mode, which is a low power consumption state, to the normal operation mode, a central processing unit (CPU), a printer unit, and other devices can simultaneously return to a normal operation. In the actual operation, however, the main CPU is activated first, and the cooling fan starts rotation, and then, the printer unit starts to operate. Consequently, the respective return operation start timing is different. In other words, for example, in a series of return operations, there is a plurality of points at which the sound levels largely change from the silent state to the low-sound level, from the low-sound level to the middle-sound level, and from the middle-sound level to the high-sound level. As a result, according to the Weber-Fechner law, a user notices the sound changes many times, and this gives the user uncomfortable feelings depending on the amounts of the sound changes.

The present invention is directed to providing a mechanism for reducing change in a level of operation sound generated at the time when an image forming apparatus starts image forming, by delaying timing for driving a fan for cooling a CPU as much as possible, depending on a received job, in a second power state which is lower in power consumption than a first power state.

SUMMARY OF THE INVENTION

According to an aspect of the present invention, there is provided an image forming apparatus in which, in receiving a job and processing an image, a central processing unit (CPU) that can be cooled by a cooling unit to which electric power is supplied from a power supply unit controls a printing unit. The image forming apparatus includes a detection unit configured to recognize that, after a power state of the image forming apparatus is shifted to a second power state lower in power consumption than a first power state, a receiving unit has received a job for returning from the second power state to the first power state, and a control unit configured to perform adjustment, if a factor in returning from the second power state to the first power state is detected, such that start timing for supplying electric power from the power supply unit to the cooling unit is delayed.

Further features of the present invention will become apparent from the following description of exemplary embodiments with reference to the attached drawings.

BRIEF DESCRIPTION OF THE DRAWINGS

FIG. 4 is a table of quantified generated sound level differences of individual units for each job type.

DESCRIPTION OF THE EMBODIMENTS

Hereinafter, exemplary embodiments of the present invention will be described with reference to the attached drawings.

<Description of System Configuration>

Figure 1:
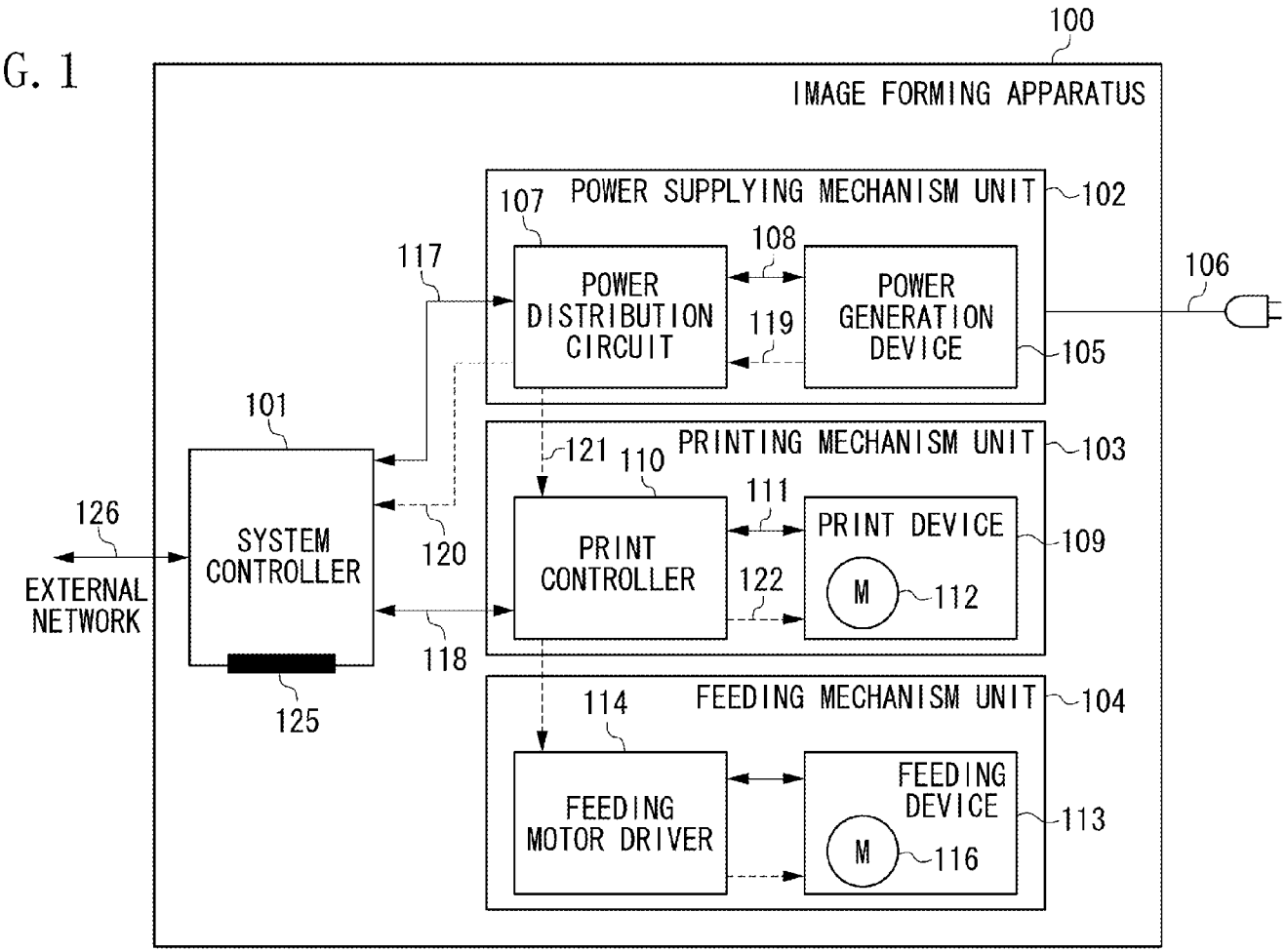
FIG. 1 is a block diagram illustrating a configuration of an image forming apparatus.

FIG. 1 is a block diagram illustrating a configuration of an image forming apparatus according to a first exemplary embodiment.

In FIG. 1, an image forming apparatus 100 for processing an image includes a system controller 101, a power supplying mechanism unit 102, a printing mechanism unit 103, and a feeding mechanism unit 104.

The system controller 101 includes a FAN 125 for cooling a controller unit including a central processing unit (CPU) 201 as described below. The power supplying mechanism unit 102 includes a power generation device 105 and a power distribution circuit 107. The printing mechanism unit 103 includes a print device 109 having a plurality of print motors 112 and a print controller 110. The print device 109 includes a development unit for developing, with developer, a latent image formed on a photosensitive member that is driven by electric power supplied from the power supply unit, a transfer unit for transferring the developed image onto a sheet, a fixing unit for fixing the developer transferred onto the sheet, and a print controller. Prior to the start of printing by the printing unit, the print controller drives and rotates the development unit, the transfer unit, and the fixing unit via belts and gears (not illustrated) with the motors 112. In this operation, operation sound of certain decibels is produced from the printing mechanism unit 103. The level of the operation sound produced at the time when the printing unit prepares for printing is higher than the level of the operation sound produced at the time when the fan serving as a cooling unit is driven.

The image forming apparatus 100 can include a reading unit for reading an image, and a document conveyance unit for conveying a document to be read so as to perform multiple function processing.

The feeding mechanism unit 104 feeds a sheet to the printing mechanism unit 103. The printing mechanism unit 103 can further include a post-processing unit for performing a post processing onto a printed sheet, and a conveyance unit for conveying the sheet printed by the printing unit to the post-processing unit.

The system controller 101 includes the FAN 125, and cools the inside of the system controller 101. The system controller 101 is connected with the power distribution circuit 107 using a power generation instruction signal 108, and via a feed path to the system controller 101, electric power is supplied from the power distribution circuit 107. The system controller 101 is also connected with the print controller 110, and can issue a print instruction to the printing mechanism unit 103. In a state where the image forming apparatus 100 is not operating, the system controller 101 can stand by in a low power consumption state.

The power supplying mechanism unit 102, according to an instruction from the system controller 101, supplies electric power to a feed path to the system controller 101, a feed path to the printing mechanism unit 103, and a feed path to the feeding mechanism unit 104. This electric power is generated by the power generation device 105 using the electric power from a power supply inlet 106, and supplied to the power distribution circuit 107 via a main feed path 119. In a state where the image forming apparatus 100 is not operating, the power supplying mechanism unit 102 can stand by in a low power consumption state.

The printing mechanism unit 103 performs printing according to an instruction from the system controller 101. The specific printing mechanism is not related to the main subject of the present invention, and accordingly, its description is omitted. The print controller 110 drives the plurality of print motors 112 and a printing unit (not illustrated) to perform printing onto a sheet. In a state where the image forming apparatus 100 is not operating, the power supply to the printing mechanism unit 103 from the power distribution circuit 107 is stopped, and the printing mechanism unit 103 can be in a complete power-off state. Meanwhile, to start printing, preparation such as temperature management and cleaning is necessary.

The feeding mechanism unit 104 conveys a sheet according to an instruction from the system controller 101. The specific sheet conveyance mechanism is not related to the main subject of the present invention, and accordingly, its description is omitted. A feeding motor driver 114 drives a feeding motor and feeding rollers (not illustrated) to convey the sheet. In a state where the image forming apparatus 100 is not operating, the power supply to the feeding mechanism unit 104 from the power distribution circuit 107 is stopped, and the feeding mechanism unit 104 can be in a complete power-off state.

Figure 2:
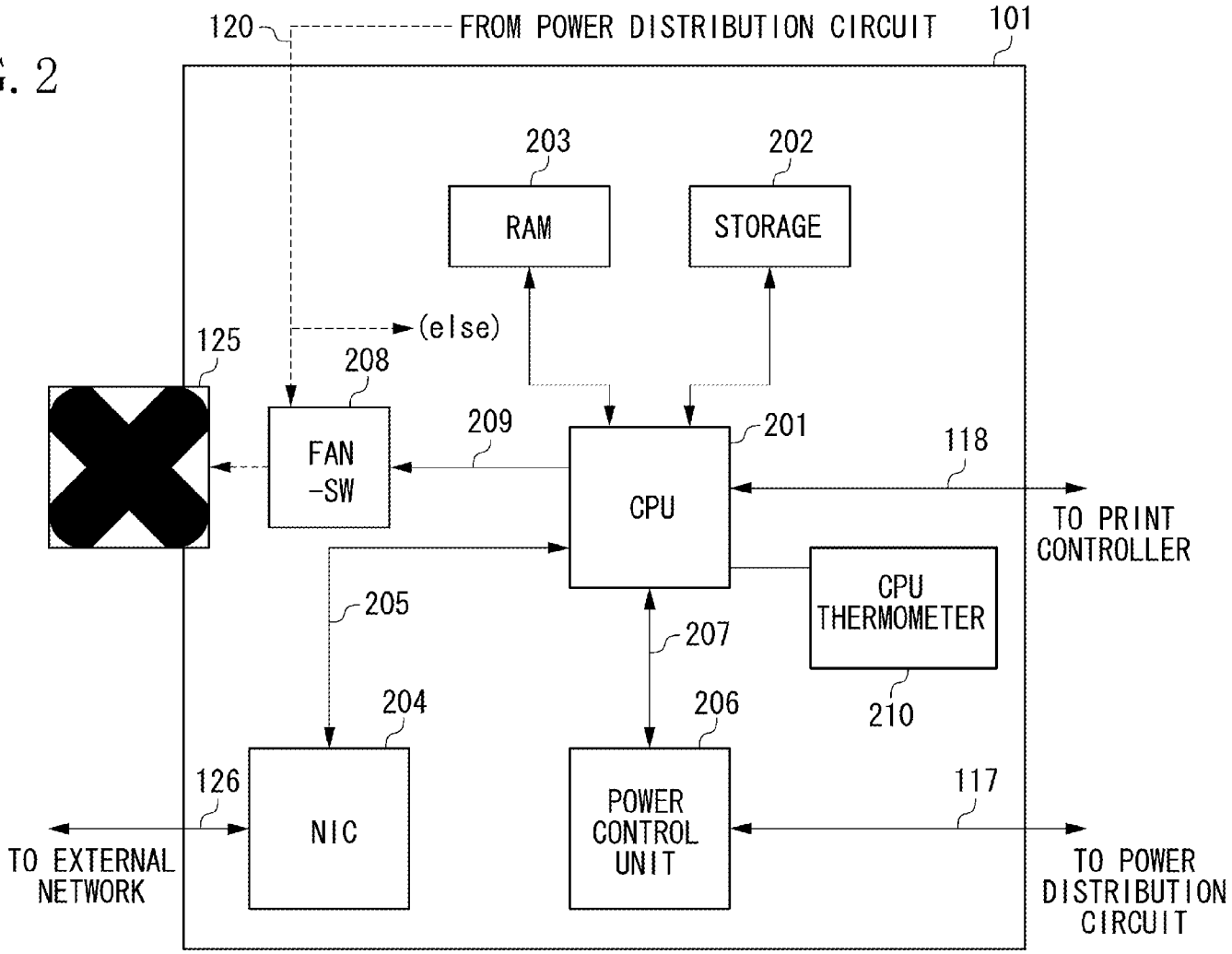
FIG. 2 is a block diagram illustrating a configuration of a system controller.

FIG. 2 is a block diagram illustrating a configuration of the system controller 101 illustrated in FIG. 1.

In FIG. 2, the system controller 101 includes a central processing unit (CPU) 201, a storage 202, a random access memory (RAM) 203, a network controller (NIC) 204, a FAN-SW 208, a power supply control unit 206, and a CPU thermometer 210. To the CPU 201, a drive signal (not illustrated) is input, and the CPU 201 receives the drive signal. This increases the temperature of the CPU 201 to a high temperature, and consequently, control to prevent thermal runaway in the CPU 201 is performed by cooling the CPU 201 by the FAN 125.

The CPU 201 is a center of the system controller 101, and performs overall control of the image forming apparatus 100. The CPU 201, using software stored in the storage 202, instructs the RAM 203 to operate as a temporary storage. In a state where the print controller 110 in the image forming apparatus 100 is not operating, the CPU 201 can stand by in a low power consumption state. In such a state, the power supply is continued only to the RAM 203, and the power supply to the storage 202 is stopped.

The NIC 204 is connected to an external network 126, and connected to the CPU 201 by a NW communication signal 205. The NIC 204 performs alternative processing of the communication between the CPU 201 and the external network 126. In a state where the image forming apparatus 100 is not operating, the NIC 204 stands by in a low power consumption state, and prepares for job input from the external network 126.

The power supply control unit 206 is connected to the CPU 201, and performs power distribution control of the power distribution circuit 107 according to an instruction from the CPU 201. The CPU thermometer 210 is connected to the CPU 201, and detects the temperature of the CPU 201 and responds to an inquiry from the CPU 201.

Figure 3A:
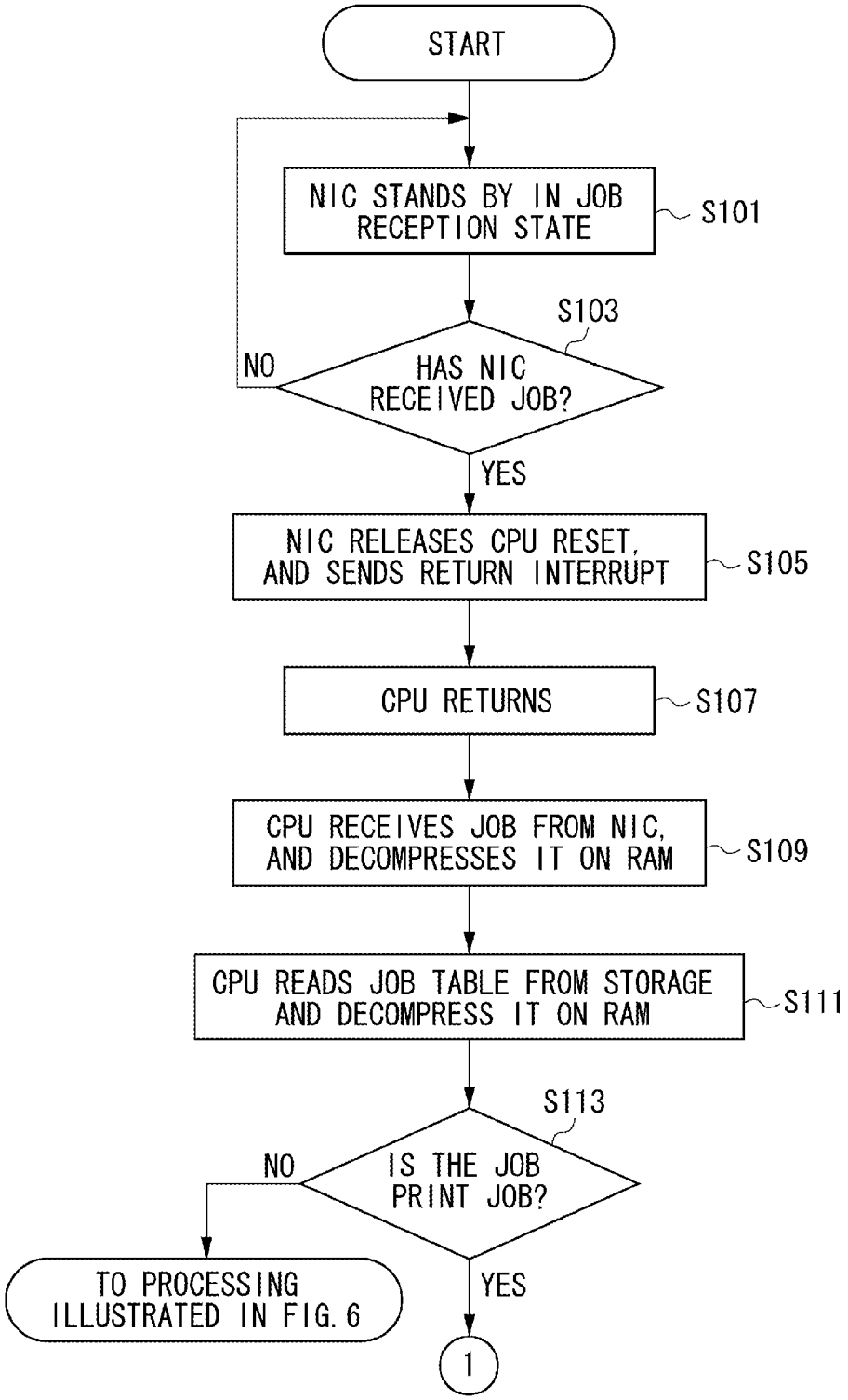
FIGS. 3A and 3B are a flowchart illustrating a control method of the image forming apparatus.
Figure 3B:
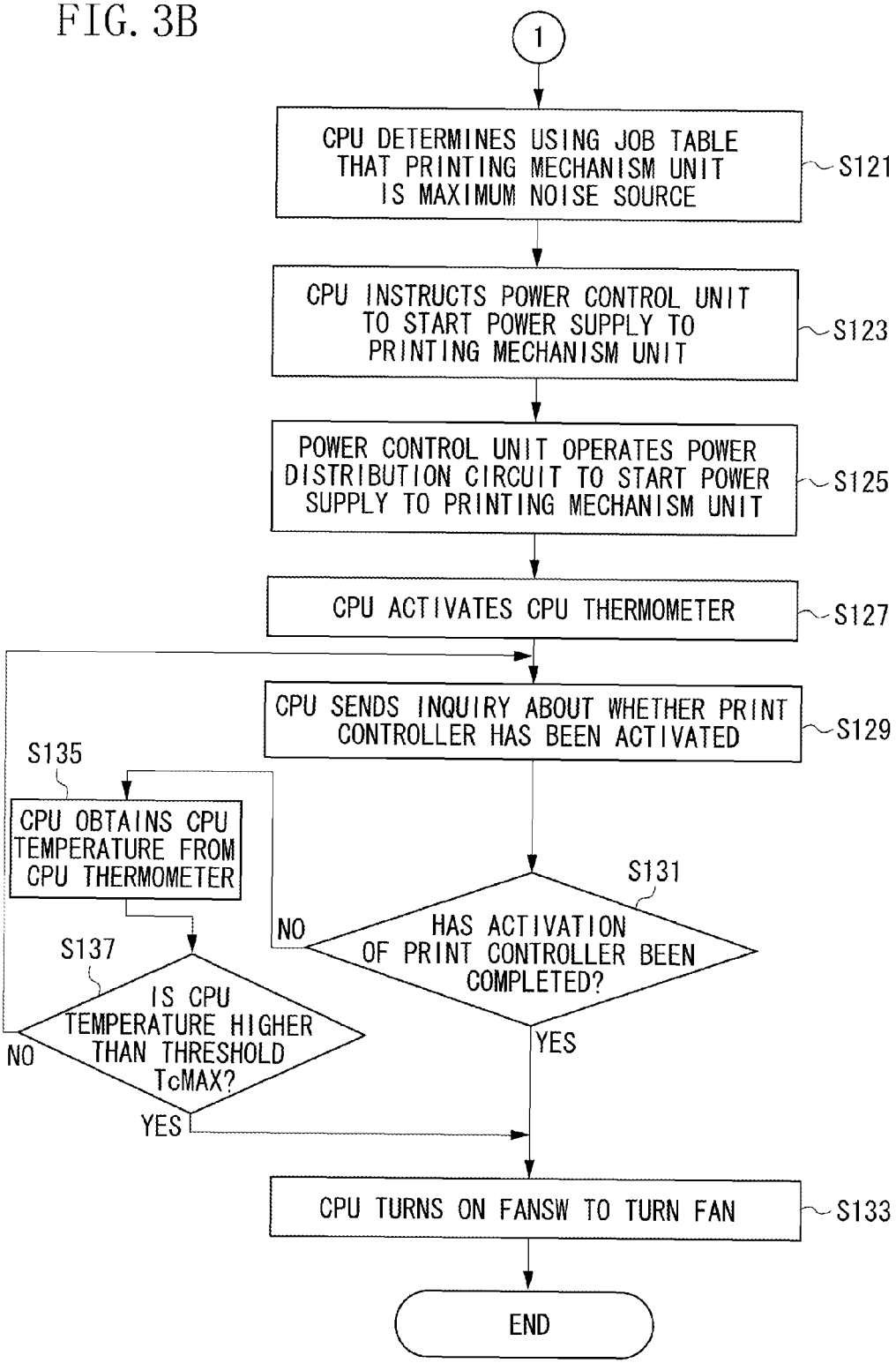

FIGS. 3A and 3B are a flowchart illustrating a method of controlling the image processing apparatus according to the exemplary embodiment. In this exemplary embodiment, operation sound is reduced that people sense, and the operation sound is generated at the time when the image forming apparatus 100 returns to a standby state after the image forming apparatus 100 shifts to a power-saving state (low power consumption state). In this description, the jobs to be input include, for example, a "print" job, and a "storage" job.

Each step is implemented by executing a control program by the CPU 201. Hereinafter, processing for adjusting operation timing such that the timing of the FAN 125 having a lower operation sound level is delayed as compared to the operation timing of the printing mechanism unit 103 is described.

In step S101, in a low power consumption state, in the system controller 101, the electric power is supplied only to the NIC 204 and the power supply control unit 206, and the system controller 101 stands by in a state where the system controller 101 waits for job input from the external network 126. In this state, in the image forming apparatus 100, the power distribution circuit 107 has been stopping the power supply to the printing mechanism unit 103, and consequently, the state is shifted to the low power consumption state which is lower in power consumption than the standby state in which an image can be formed.

If the NIC 204 receives a job input from the external network 126 (YES in step S103), in step S105, the NIC 204 releases the reset of the CPU 201, and sends a return interrupt to the CPU 201 via the NW communication signal 205. In step S107, the CPU immediately returns.

In step S109, the CPU 201 receives the job input from the NIC 204 via the NW communication signal 205, and decompresses the job on the RAM 203. In step S111, the CPU 201 reads a job table from the storage 202, and decompresses the job table on the RAM 203. If the CPU 201 determines that the type of the received job is a "print" job (YES in step S113), based on the job content decompressed on the RAM 203, the CPU 201 determines that the type of the input job is a "print" job, and refers to the job table illustrated in FIG. 4, for example. The processing in step S113 corresponds to determining a factor in returning from a second power state to a first power state depending on the type of job.

FIG. 4 illustrates an example of the job table stored and managed by the image forming apparatus according to the exemplary embodiment.

In the job table illustrated in FIG. 4, for each type of job to be performed by the image forming apparatus 100, whether to activate units in the image forming apparatus 100, and generated sound level differences of the individual units are quantified.

In the job table, all receivable jobs and all units in the image forming apparatus 100 are associated with each other, and the numeric values indicate differences in levels of the sound generated in an operating state and in a non-operating state in the individual units. In the case of "0", for example, if the type of job is the storage job, the table indicates that the printing mechanism unit is not to be activated.

The CPU 201 refers to the print job line in the job table, and determines units to be activated and a unit to be a maximum noise source in the units. In step S121, as illustrated in FIG. 4, the CPU 201 determines that units to be activated by the print job are the CPU thermometer 210, the FAN 125, and the printing mechanism unit 103, and that the maximum noise source is the printing mechanism unit 103 having the maximum generated sound level difference.

Since it is determined that the maximum noise source is the printing mechanism unit 103, first, the CPU 201 activates the printing mechanism unit 103.

In step S123, the CPU 201 instructs the power supply control unit 206 to start power supply to the printing mechanism unit 103. In step S125, the power supply control unit 206 shuts, via a power distribution instruction signal, the circuit to the printing mechanism unit 103 in the power distribution circuit 107, and starts power supply to the printing mechanism unit 103. In step S127, the CPU 201 instructs the CPU thermometer 210 to activate.

In the printing mechanism unit 103, when the power supply is started, the print controller 110 automatically starts to activate, and the activated print controller 110 initializes the print motors 112, and other components. Consequently, there is a time difference between the activation of the print controller 110 and the activation of the print motors 112, which are the noise source. In step S129, the CPU 201, via a print control signal 111, inquires whether the print controller 110 has been activated. If the CPU 201 determines that the activation of the print controller 110 has been completed (YES in step S131), in step S133, the CPU 201 turns on the FAN-SW 208 to turn the FAN 125.

If the CPU 201 determines that the activation of the print controller 110 has not been completed (NO in step S131), in step S135, the CPU 201 obtains a temperature of the CPU 201 from the CPU thermometer 210. The CPU 201 stores a highest temperature the CPU 201 can endure, as a threshold value in advance. If the CPU 201 determines that the temperature of the CPU 201 obtained from the CPU thermometer 210 is higher than the threshold value (YES in step S137), in step S133, the CPU 201 turns on the FAN-SW 208 to turn the FAN 125.

If the CPU 201 determines that the temperature of the CPU 201 obtained from the CPU thermometer 210 is lower than the threshold value (NO in step S137), the CPU 201 continues the activation confirmation inquiry to the print controller 110 (S129).

Figure 5:
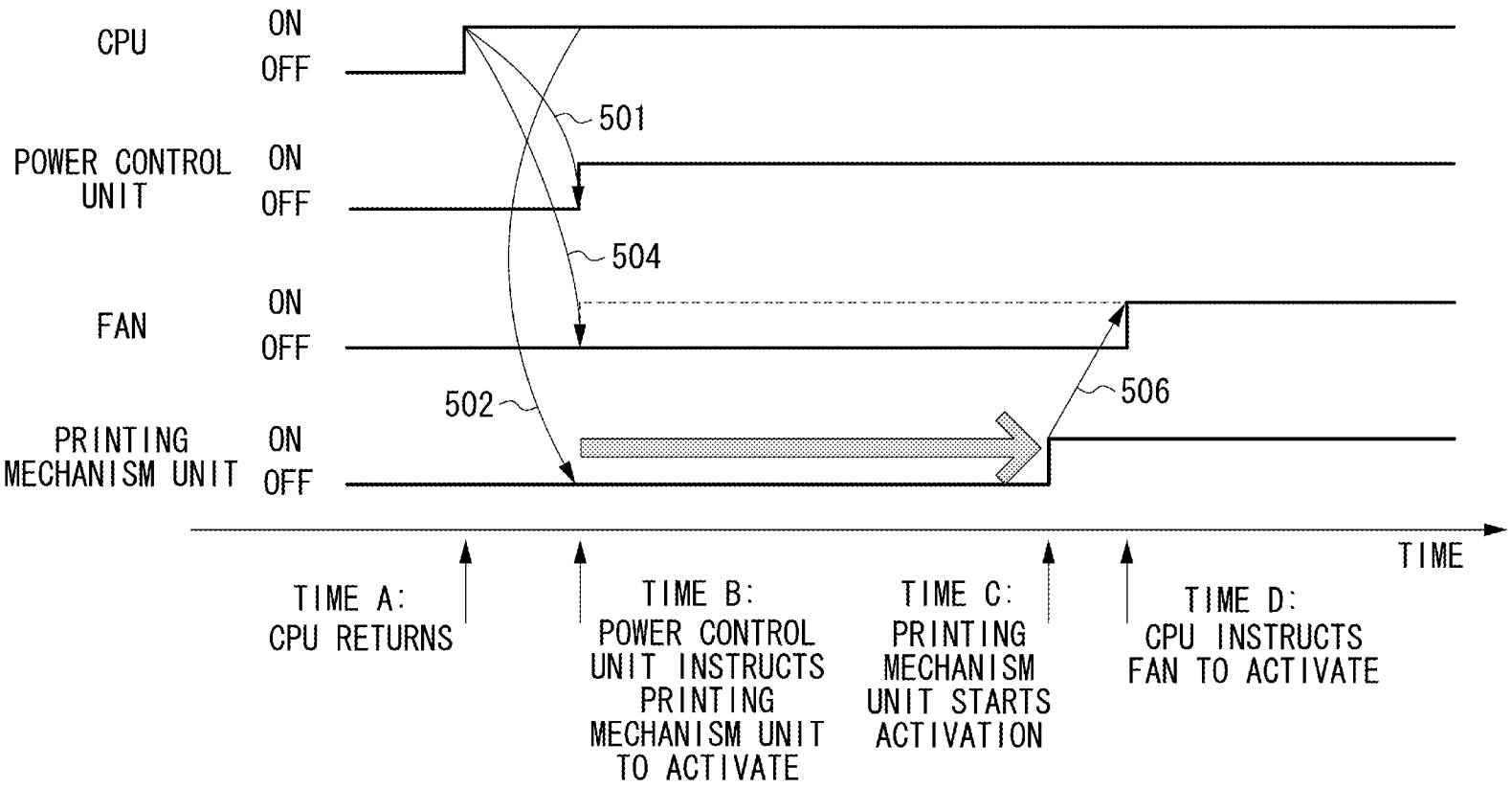
FIG. 5 illustrates drive timing of individual devices in the image forming apparatus.

This processing flow is represented on the time axis in the timing chart in FIG. 5. In FIG. 5, in response to input of a job, at time A, the CPU 201 is activated, and at time B, the CPU 201 can issue an instruction for activating a unit. If the activation order is not so important, the CPU 201 can simultaneously issue an activation instruction (501) to the power supply control unit 206, that is, an activation instruction (502) to the printing mechanism unit 103, an activation instruction (503) to the CPU thermometer 210, and an activation instruction (504) to the FAN 125. In reality, however, a time difference occurs due to the activation of the print controller 110 from the time when the power supply control unit 206 instructs the printing mechanism unit 103 to activate at time B to the time when the printing mechanism unit 103 starts to activate at time C. Although the CPU thermometer 210 and the FAN 125 can be immediately activated in response to activation instructions, if the activation instructions are simultaneously issued at time B, the CPU thermometer 210 and the FAN 125 are activated before time C (the broken line in FIG. 5). Consequently, the CPU 201 waits for the start of the activation of the printing mechanism unit 103 at time C, and when the printing mechanism unit 103 starts to activate, the CPU 201 issues an activation instruction (505) to the CPU thermometer 210 and an activation instruction (506) to the FAN 125.

Figure 6:
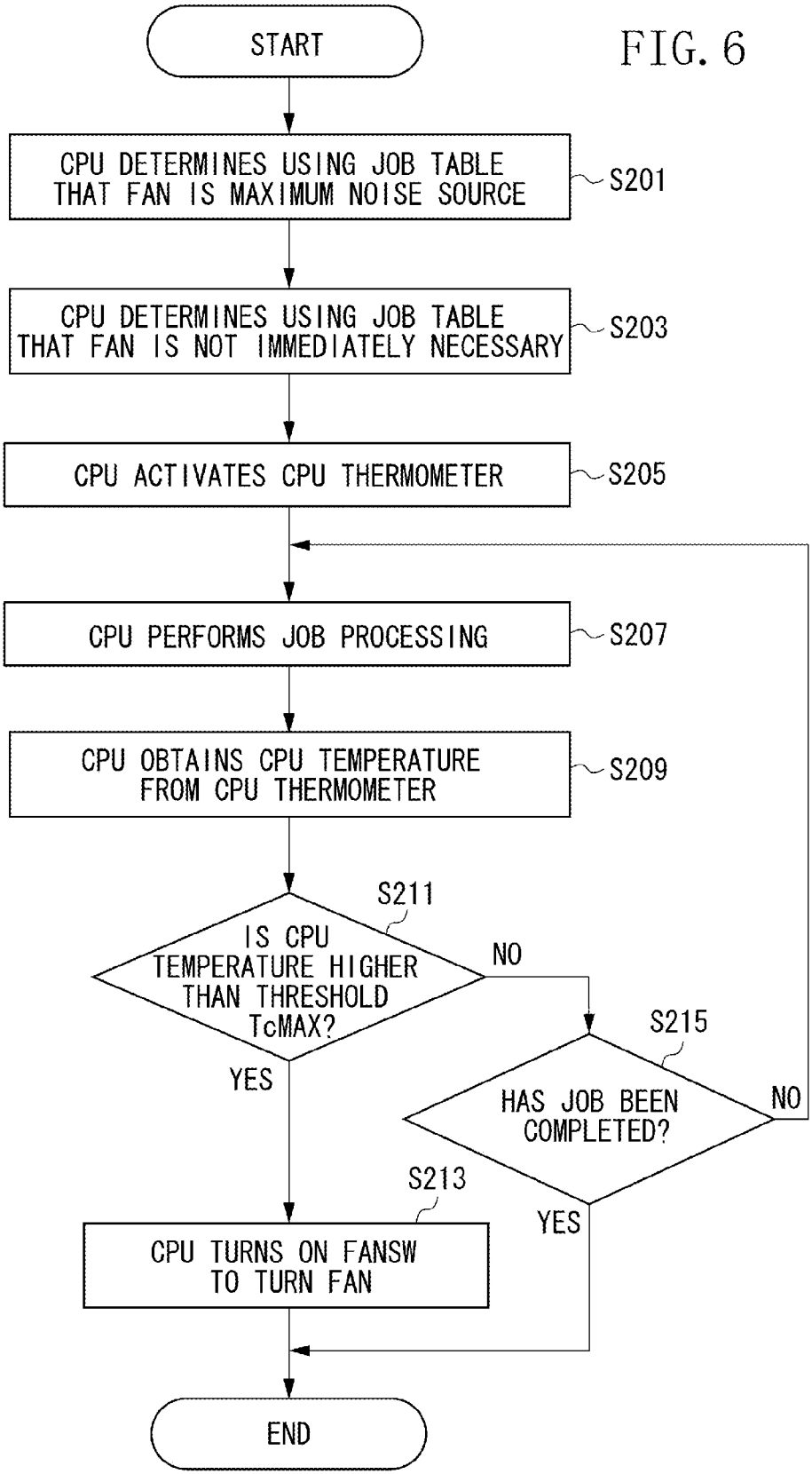
FIG. 6 is a flowchart illustrating a control method of the image forming apparatus.

If the type of the received job is a "storage" job (NO in step S113), the CPU 201 starts the control illustrated in FIG. 6.

FIG. 6 is a flowchart illustrating a method of controlling the image processing apparatus according to the exemplary embodiment. This example is an example of activating the units in the image forming apparatus at the time when the type of the received job is the storage job.

In step S201, the CPU 201 refers to the storage job line in the job table illustrated in FIG. 4, and determines units to be activated and a unit to be a maximum noise source in the units.

According to the table illustrated in FIG. 4, the CPU 201 determines that the units to be activated by the storage job are the CPU thermometer 210 and the FAN 125, and the maximum noise source is the FAN 125 having the maximum generated sound level difference.

In this example, the type of the job is the storage job, and in step S203, the CPU 201 determines that the FAN 125 is not immediately necessary. In step S205, the CPU 201 instructs the CPU thermometer 210 to activate. In step S207, the CPU 201 starts the job prior to the activation of the FAN 125. In step S209, the CPU 201 obtains a temperature of the CPU 201 from the CPU thermometer 210. If the CPU 201 determines that the obtained temperature of the CPU 201 is higher than the threshold value (YES in step S211), in step S213, the CPU 201 turns on the FAN-SW 208 to turn the FAN 125. If the CPU 201 determines that the temperature of the CPU 201 obtained while processing the job is lower than the threshold value (NO in step S211), in step 215, if the CPU 201 has not completed the job (NO in step S215), the CPU 201 continues the job. If the CPU 201 determines that the job has been completed (YES in step S215), the CPU 201 ends the activation processing.

According to the exemplary embodiment of the present invention, the image forming apparatus determines the type of the job received in the power-saving state, and determines the activation order based on the units to be activated for the job, and levels of sound generated by the units. In this operation, a unit having a large generated sound level difference between in an operating state and in a non-operating state is activated first. Consequently, if units having lower generated sound level differences are activated later, according to the Weber-Fechner law, people cannot notice the activation sound of the units.

That is, while a plurality of units are being activated, people notice the activation sound only once, and consequently, the number of times the sound is noticed can be reduced.

If the type of the received job is the storage job, while the FAN 125 is the maximum noise source, it is determined that the FAN 125 is not immediately necessary for the job, and the job starting timing is set prior to the activation of the FAN 125.

By doing so, the image forming apparatus can perform the job without turning the FAN 125 as long as the temperature of the CPU 201 is lower than the threshold value. That is, a job that can be processed in a very short time can be processed in a silent state. Further, by using the CPU thermometer 210 together as a protection circuit, even if the CPU 201 overheats while the start of rotation of the FAN 125 is delayed, if necessary, the FAN 125 can be exceptionally turned to cool the CPU 201.

In this exemplary embodiment, the print job and the storage job are described as an example, and alternatively, other jobs that can be processed by the image forming apparatus 100 such as a facsimile machine can also be used. Further, if a maximum noise source is an image reading mechanism or a sheet feeding mechanism that are generally provided in the image forming apparatus 100, similar processing is performed.

In this exemplary embodiment, the present invention is employed for the activation processing of the hardware devices in the image forming apparatus illustrated in FIG. 1.

In the hardware devices provided in the image forming apparatus, the devices that generate drive sound in the activation processing are unique to the apparatus, and consequently, various modifications can be expected.

Consequently, in exemplary embodiments for which the present invention can be employed, various combinations of the devices to be driven so that the image forming apparatus shifts to a standby state can be expected. To person skilled in the art, it is obvious that the present invention can be implemented by adding a general component (not illustrated) to the image forming apparatus 100.

In a case where the CPU determines, from values of the CPU thermometer 210, that from when the printing mechanism unit 103 starts to drive, temperature in the CPU 201 starts to rise, and the temperature exceeds a predetermined threshold value within a predetermined time, the above-described flow can include control for immediately turning the FAN 125. In a case where the CPU determines, from values of the CPU thermometer 210, that at the time when the printing mechanism unit 103 starts to drive, temperature in the CPU 201 starts to rise, and the temperature exceeds the predetermined threshold value, the above-described flow can include control for immediately turning the FAN 125.

If a drive member that generates sound higher in level than the operation sound generated by the printing mechanism unit 103, for example, a FIN is provided, control can be performed such that the member starts to drive simultaneously with the printing mechanism unit 103.

The above-described flow can include control for stopping the operation of the FAN 125, before the operation of the printing mechanism unit 103 is completed, when the job is completed. In such a case, in a case where a job to be performed next has already been received, the CPU 201 performed control such that the above-described control is not performed to keep the FAN 125 turning.

With respect to the members to be driven for the job to be performed after the job that is currently being performed, the above-described flow can include control for driving the members to be used in the corresponding subsequent job for operation check while the preceding job is being performed.

Each step in the exemplary embodiments of the present invention can be implemented by executing software (program) acquired via a network or various storage media using a processing device (CPU or processor) of a personal computer (computer) or the like.

It is to be understood that the present invention is not limited to the above-described exemplary embodiments, various modifications (including organic combinations of the exemplary embodiments) can be made based on the purport of the present invention, and they are not excluded from the scope of the present invention.

According to the present invention, change in a level of operation sound generated at the time when an image forming apparatus starts image forming can be reduced, by delaying timing for driving a fan for cooling a CPU as much as possible, depending on a received job, in a second power state which is lower in power consumption than a first power state.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-272197 filed Dec. 27, 2013, which is hereby incorporated by reference herein in its entirety.

What is claimed is:

1. An image forming apparatus comprising:

a printing unit;

a processing unit configured to control the printing unit;

a cooling unit configured to cool the processing unit, the cooling unit being different from another cooling unit for cooling the printing unit;

a receiving unit configured to receive a print job for causing the printing unit to perform print processing; and a control unit configured to perform, if the receiving unit receives the print job when the image forming apparatus is in a power saving state in which power supply to the printing unit is stopped, control such that the cooling unit cools the processing unit based on temperature information of the processing unit, after power is supplied to the printing unit.

2. The image forming apparatus according to claim 1, wherein the control unit performs, if a job received by the receiving unit is not the print job, control such that the cooling unit cools the processing unit based on the temperature information of the processing unit, without waiting for power supply to the printing unit.

3. The image forming apparatus according to claim 2, further comprising a temperature detection unit configured to detect a temperature of the processing unit, wherein the cooling unit cools the processing unit when the temperature detected by the temperature detection unit exceeds a predetermined threshold.

4. The image forming apparatus according to claim 1, wherein a level of operation sound generated at a time when the printing unit performs print processing is higher than a level of operation sound generated at a time when the cooling unit performs cooling processing.

5. The image forming apparatus according to claim 1, further comprising:

a reading unit configured to read an image;

a document conveyance unit configured to convey a document to be read;

a sheet feeding unit configured to feed a sheet to the printing unit;

a post-processing unit configured to perform post-processing on the sheet printed by the printing unit; and a conveyance unit configured to convey the sheet printed by the printing unit to the post-processing unit.

6. The image forming apparatus according to claim 1, wherein the printing unit includes a development unit configured to develop, with developer, a latent image formed on a photosensitive member that is driven by electric power supplied from a power supply unit, a transfer unit configured to transfer the developed image onto a sheet, a fixing unit configured to fix the developer transferred onto the sheet, and a print controller, and before the printing unit starts to print, the print controller drives and rotates the development unit, the transfer unit, and the fixing unit.

7. A method of controlling an image forming apparatus, the image forming apparatus including a printing unit, a processing unit configured to control the printing unit, a receiving unit configured to receive a print job for causing the printing unit to perform print processing, and a cooling unit configured to cool the processing unit, the cooling unit being different from another cooling unit for cooling the printing unit; the method comprising:

receiving the print job at the receiving unit of the image forming apparatus; and performing, if the receiving unit receives the print job when the image forming apparatus is in a power saving state in which power supply to the printing unit is stopped, control such that the cooling unit cools the processing unit based on temperature information of the processing unit, after power is supplied to the printing unit.

8. A non-transitory computer-readable storage medium storing a program for instructing a computer to implement a method of controlling an image forming apparatus, the image forming apparatus including a printing unit, a processing unit configured to control the printing unit, a receiving unit configured to receive a print job for causing the printing unit to perform print processing, and a cooling unit configured to cool the processing unit, the cooling unit being different from another cooling unit for cooling the printing unit; the method comprising:

receiving the print job at the receiving unit of the image forming apparatus; and performing, if the receiving unit receives the print job when the image forming apparatus is in a power saving state in which power supply to the printing unit is stopped, control such that the cooling unit cools the processing unit based on temperature information of the processing unit, after power is supplied to the printing unit.

* * * * *